US007402972B2

(12) United States Patent
Lendi et al.

(10) Patent No.: US 7,402,972 B2
(45) Date of Patent: Jul. 22, 2008

(54) DEVICE FOR FEEDING AN ACTUATING DRIVE THAT CAN BE DRIVEN WIRELESSLY

(75) Inventors: Dominic Lendi, Ebertwil (CH); Ernst Schmuki, Eschenbach (CH); Beat Suter, Oberarth (CH)

(73) Assignee: Siemens Schweiz AG, Zurich (CH)

( * ) Notice: Subject to any disclaimer, the term of this patent is extended or adjusted under 35 U.S.C. 154(b) by 0 days.

(21) Appl. No.: 11/441,871

(22) Filed: May 26, 2006

(65) Prior Publication Data

US 2006/0279238 A1 Dec. 14, 2006

(30) Foreign Application Priority Data

May 27, 2005 (EP) ..... 05011436

(51) Int. Cl.
*G05B 11/01* (2006.01)

(52) U.S. Cl. ..... 318/560; 318/568.12; 318/568.16; 318/577; 318/587; 318/563

(58) Field of Classification Search ..... 318/560, 318/568.12, 568.16, 577, 587, 563, 565, 318/139; 364/424.02; 340/5.73
See application file for complete search history.

(56) References Cited

U.S. PATENT DOCUMENTS

| | | | | |
|---|---|---|---|---|
| 5,576,605 | A * | 11/1996 | Miyazawa | 318/568.12 |
| 5,813,655 | A | 9/1998 | Pinchott et al. | |
| 6,116,201 | A * | 9/2000 | LaBelle | 123/179.2 |
| 6,136,184 | A * | 10/2000 | King | 210/136 |
| 2004/0222767 | A1 | 11/2004 | Ohkouchi et al. | |
| 2004/0231716 | A1 | 11/2004 | Litwin | |
| 2006/0038657 | A1 * | 2/2006 | Denison et al. | 340/5.73 |

FOREIGN PATENT DOCUMENTS

| | | |
|---|---|---|
| DE | 28 00 704 A | 7/1979 |
| DE | 43 08 031 A1 | 4/1994 |

* cited by examiner

*Primary Examiner*—Karen Masih
(74) *Attorney, Agent, or Firm*—Maginot, Moore & Beck

(57) ABSTRACT

An actuating drive (60), that can be fed by a battery (6), for an actuator (5) comprises a drive unit (61) for operating the actuator (5), and a control unit (62), capable of communicating with an external station (70) in a wireless fashion, for controlling the drive unit (61). The control unit (62) can be fed via a voltage regulator (64) connected to the battery (6), while the drive unit (61) is directly connected to the output voltage ($U_B$) of the battery (6). The energy consumption of the actuating drive (60) can be optimized in order to achieve a long service life for the battery.

11 Claims, 4 Drawing Sheets

DEVICE FOR FEEDING AN ACTUATING DRIVE THAT CAN BE DRIVEN WIRELESSLY

The invention relates to a device for feeding an actuating drive that can be driven wirelessly.

Such devices are used advantageously in battery-operated valve drives that can be driven wirelessly, for example in a radiator valve that can be controlled by radio.

Wirelessly drivable actuating drives are advantageously operated as an island device, which here means that such actuating drives are also to be equipped locally with an electric energy source, as a rule with a battery.

It is known to supply devices with energy in a wireless fashion. Thus, for example, it is proposed in DE 28 00 704 A to equip a valve actuating drive with an ultrasonic receiver, and also to feed the valve actuating drive via a pipeline network with energy for charging a battery via ultrasound.

The energy demand required for movements in a drive is generally substantially greater than the energy that is to be provided for a wireless data communication with a system environment. Particularly in the case of a drive in which a battery is used instead of a wire-bound electric energy supply via an energy supply network or over a data bus—the need arises to handle the energy stored in the battery sparingly so that changing the battery need be undertaken as seldom as possible.

It is the object of the invention to provide an actuating drive that can be driven wirelessly and fed with the aid of a battery and whose energy consumption is optimized.

Advantageous refinements follow from the dependent claims.

Figure 1:
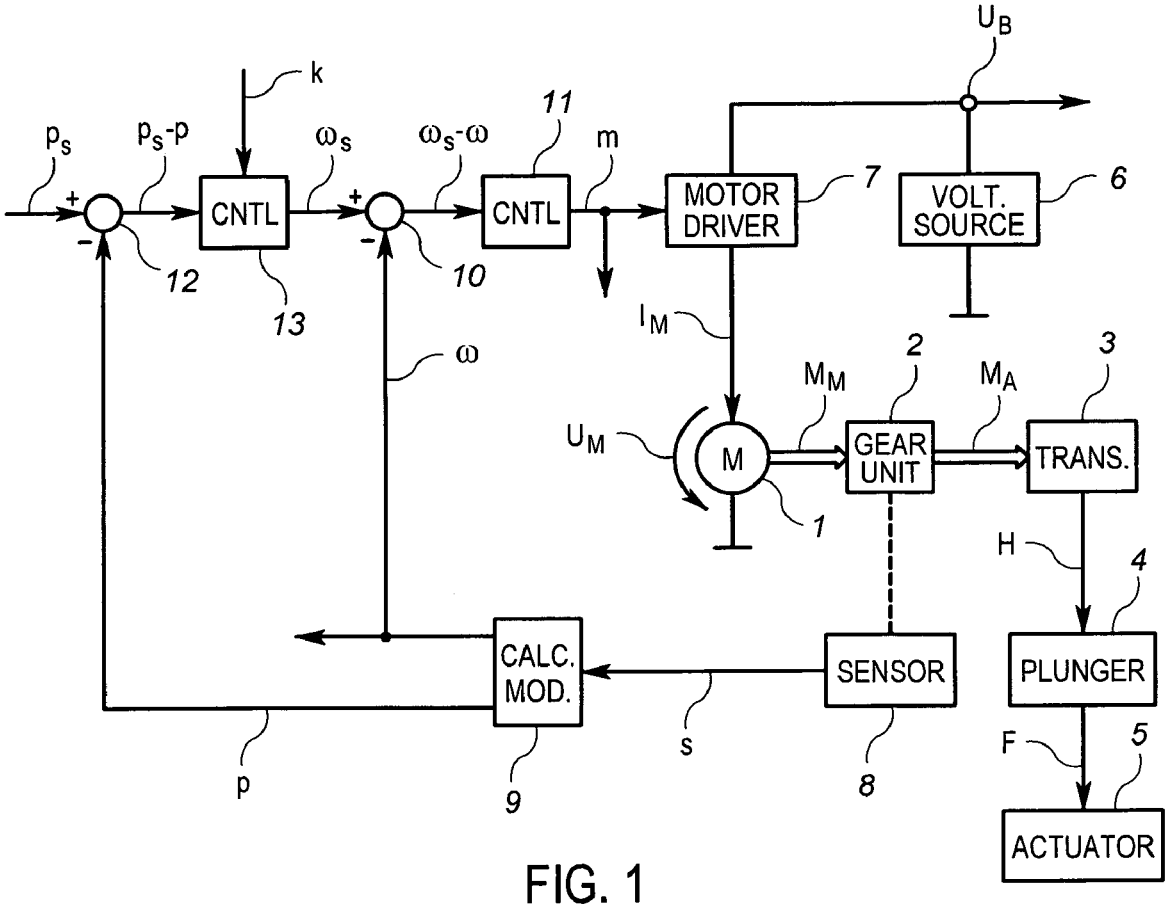
Figure 2:
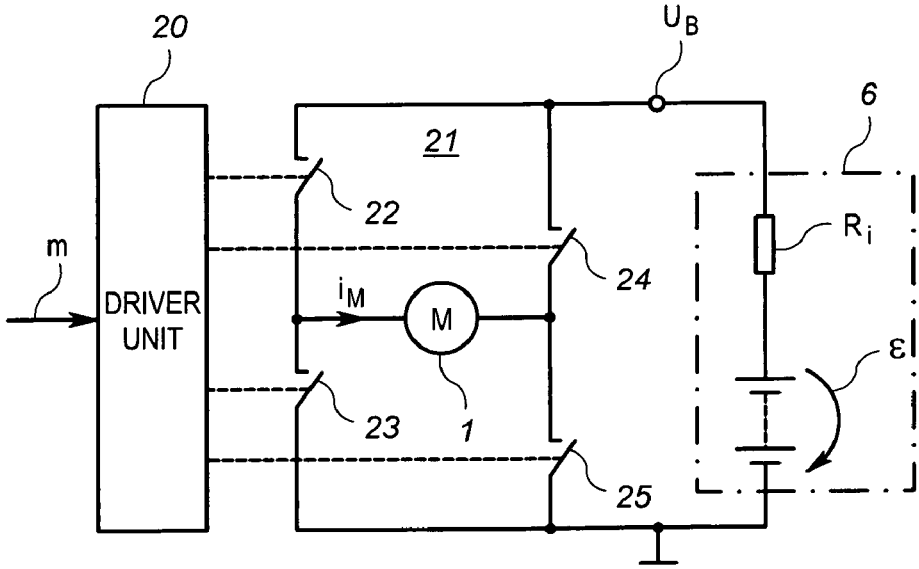
Figure 3A:
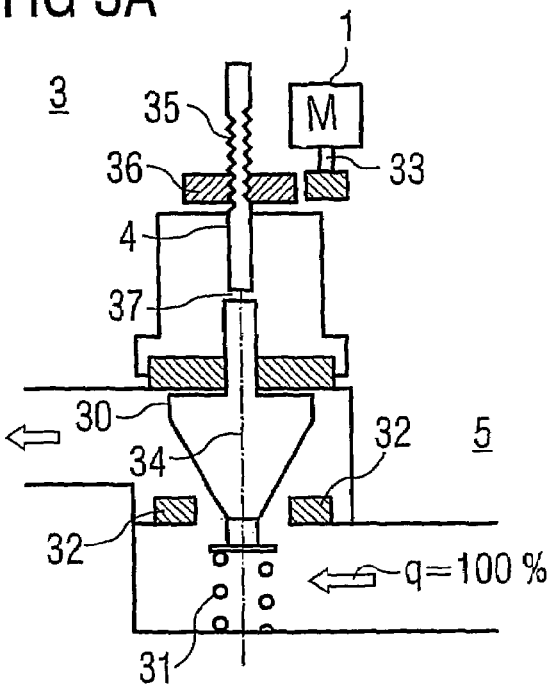
Figure 3B:
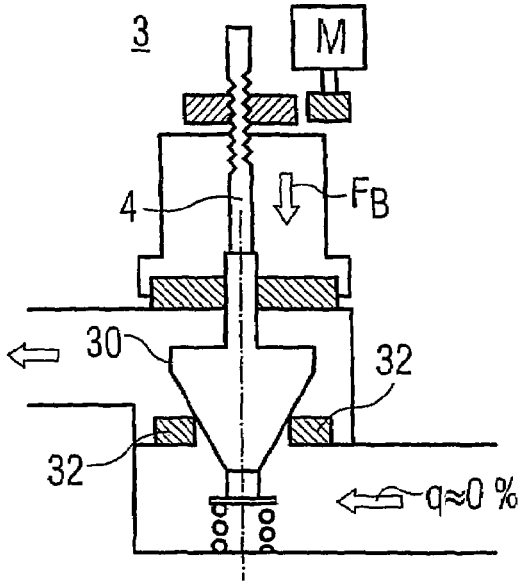
Figure 3C:
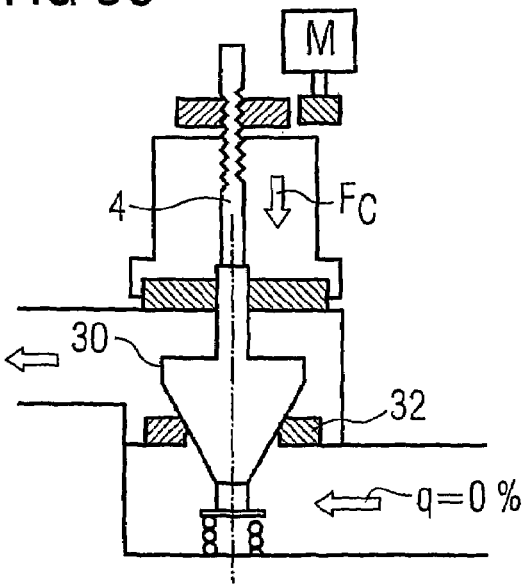
Figure 4:
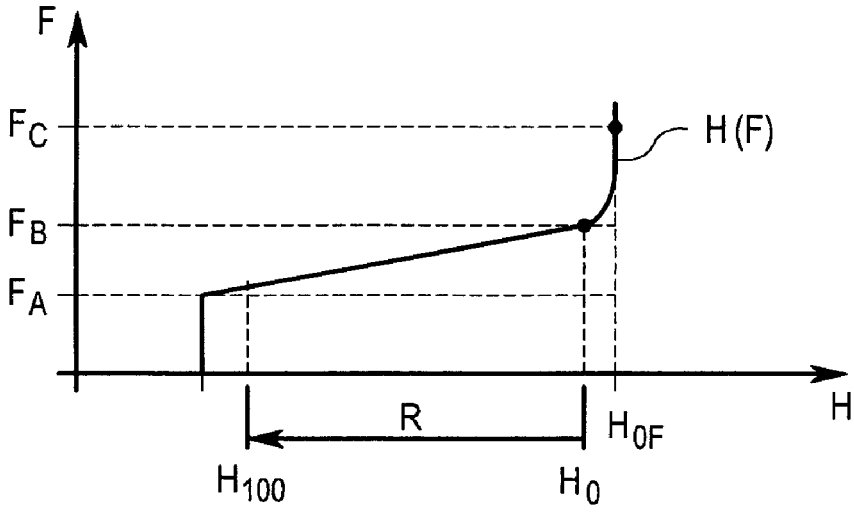
Figure 5:
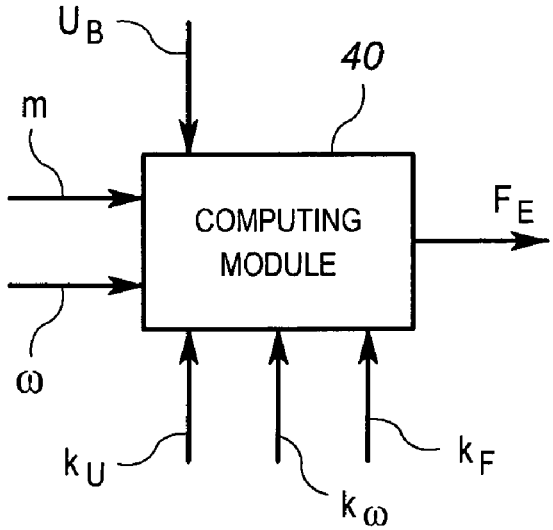
Figure 6:
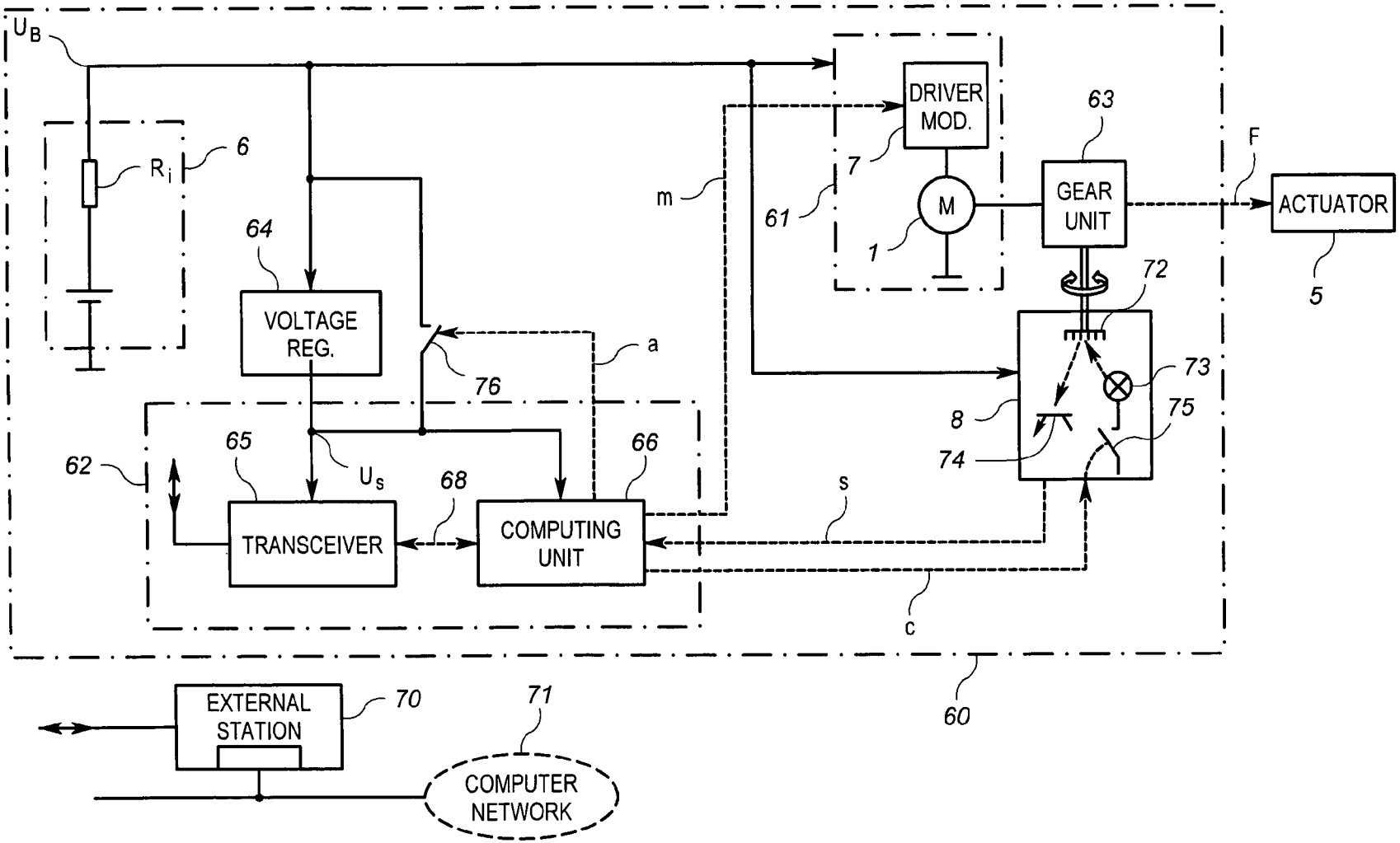

In the figures:

FIG. 1 shows a block diagram of a control device of an actuating drive,

FIG. 2 shows a block diagram relating to the mode of operation of a motor driver module, FIG. 3 shows states of an actuator, FIG. 4 shows a diagram relating to the profile of an actuating force, FIG. 5 shows a computing module for calculating the actuating force, and FIG. 6 shows a further block diagram for the purpose of illustrating an optimized energy allocation in the battery-fed actuating drive.

Denoted by numeral 1 in FIG. 1 is an electric motor that is coupled to a transformation element 3 via a gear unit 2. A turning moment $M_M$ generated by the electric motor 1 is converted by the gear unit 2 into a drive torque $M_A$ transmitted to the transformation element 3. The transformation element 3 transforms the rotary movement generated by the electric motor 1 into a longitudinal movement with a travel H. Owing to the longitudinal movement, a plunger 4 acts on an actuator 5 with an actuating force F. Here, the actuator 5 is a valve with a closing body on which the plunger 4 acts. The valve is typically a continuously adjustable valve in a heating or cooling water circuit, for example a radiator valve.

The electric motor 1 is fed via a motor driver module 7 connected to a voltage source 6.

A sensor device 8 for detecting a rotary movement is arranged at the gear unit 2. A signal s generated by the sensor device 8 is fed to a calculation module 9, for example. A speed signal ω and a position signal p are advantageously generated in the calculation module 9 with the aid of the signal s.

A control device of an actuating drive for the actuator 5 has an inner closed loop and, advantageously, also an outer closed loop. The inner closed loop leads from the sensor device 8 via the speed signal ω, converted by the calculation module 9, and a first comparing device 10 via a first control module 11 to the motor driver module 7. The outer control loop leads from the sensor device 8 via the position signal p, converted by the calculation module 9, and a second comparing device 12 via a second control module 13 to the first comparing device 10, and from there via the first control module 11 to the motor driver module 7. At the second comparing device 12, a desired position signal $p_s$ of the actuating element is advantageously fed in as command variable.

In an advantageous exemplary embodiment of the actuating drive, the electric motor 1 is a DC motor, and the motor driver module 7 has a driver unit 20 (FIG. 2) and a bridge circuit 21, connected to the battery voltage $U_B$, for driving the electric motor 1. Four electronic switches 22, 23, 24 and 25 of the bridge circuit 21 can be driven by the driver unit 20. The duration and the polarity of a current $I_M$ through the electric motor 1 can be controlled from the driver unit 20 by means of corresponding states of the four switches 22, 23, 24 and 25. The driver unit 20 can advantageously be driven via a control signal m.

The control signal m is, for example, a signal whose pulse width can be modulated by the first control module 11.

The driver unit 20 is, for example, an integrated module, while the electronic switches 22, 23, 24 and 25 are implemented, for example, by MOS field effect transistors.

The motor driver module 7 is fundamentally to be adapted in design to a selected motor type, a suitable motor type being selected depending on what is required of the actuating drive, and an electronic commutating circuit adapted to the motor type being used instead of the bridge circuit 21, for example.

The actuator 5 illustrated in simplified form in FIGS. 3*a*, 3*b* and 3*c* is, for example, a valve having a closing body 30 that can be used as actuating element and can be moved toward a valve seat 32 via the plunger 4 against the force of a spring 31. Depending on the direction of rotation of a drive spindle 33 of the electric motor 1, the plunger 4 can be moved to and fro on a longitudinal axis 34 of the closing body 30. Here, the transformation element 3 is an external thread 35, formed on the plunger 4, connected to an internal thread formed on a gearwheel 36.

The valve is illustrated in FIG. 3*a* in an open state, and so the closing body 30 is in a first final position, and a possible flow rate q for a fluid is 100%. The plunger 4 is also in a final position, an air gap 37 being formed between the plunger 4 and the closing body 30. Particularly when the valve drive can be mounted as universal drive on different valve types, individually achievable final positions will not correspond exactly for closing body and valve drive. It is advantageous to define common final positions of the valve drive and of the closing body after mounting in a calibration method, and to store them advantageously in a travel model in the actuating drive.

In FIG. 3*b*, the plunger 4 acts with an actuating force $F_B$ on the closing body 30, which rests on the valve seat 32 in the state illustrated. In this state, the flow rate q is approximately 0%, the valve being virtually closed.

In the state of the valve illustrated in FIG. 3*c*, the plunger 4 acts with a larger actuating force $F_C$—referred to the state illustrated in FIG. 3*b*—on the closing body 30 such that the closing body 30 is pressed into the valve seat 32. The valve seat 32 is made here, for example, from an elastic material that is deformed given the appropriately large actuating force $F_C$ of the closing body 30. In this state, the flow rate q is 0%, the valve being tightly closed.

A travel model of a valve is illustrated in FIG. 4 as a fundamental profile H(F). The profile H(F) shows the relationship between the travel H of the closing body 30 and the actuating force F applied to the closing body 30. Down to a minimum value $F_A$, the closing body 30 remains in the first final position illustrated in FIG. 3*a*. In order for the closing body 30 to be able to move toward the valve seat 32, the plunger 4 working against the spring 31 must overcome an approximately linearly increasing actuating force F. Depicted in the diagram at a certain value $F_B$ of the actuating force is an associated reference value $H_0$ of the travel. The reference value $H_0$ corresponds to a state of the actuator for which the closing body 30 functioning as actuating element reaches the valve seat 32. An additional travel beyond the reference value $H_0$ toward a shutoff value $H_{0F}$ requires the actuating force F to be increased beyond the value $F_B$ toward the value $F_C$ in a strongly disproportionate fashion. However, the disproportionate increase in the actuating force F also requires a sharp increase in the instantaneous power of the electric motor 1 and thus a correspondingly high energy consumption.

In an advantageous control method, in which the flow rate q is to be controlled with the aid of the actuator 5, the reference value $H_0$ is as far as possible not exceeded if the aim is a minimum energy consumption of the actuating drive, which is advantageously to be the aim in the case of an energy supply by means of a battery.

In an advantageous calibration method for an actuator that has an actuating element with at least one mechanically blocked final position, a force provided by the actuating drive, or a turning moment provided by the actuating drive is advantageously detected and, once a predetermined value of the force or of the turning moment has been reached, the current position of the actuating element is detected and stored as mechanical final position of the actuator or of the actuating element, and taken into account in a control method.

The calibration method is initiated, for example, via a start signal k fed to the second control module 13 (FIG. 1). The rotational frequency of electric motor 1 during the calibration method is advantageously held constant at a low value by comparison with a normal operation, this being done by appropriately adapting the speed setpoint $\omega_s$ generated by the second control module 13.

If, for example, the actuator is a thermostat valve that is open in the idle state and whose travel H behaves in principle as illustrated in FIG. 4 as a function of the actuating force F, the closing body is advantageously moved beyond the reference value $H_0$ of the travel only in the calibration method.

A control range R (FIG. 4) stored in the travel model of the actuating drive is advantageously fixed as a function of the determined reference value $H_0$. The control range R for the exemplary thermostat valve therefore comprises final positions, useful for control, at $H_0$—that is to say closed, or flow rate q≅0% and $H_{100}$—that is to say open, or flow rate q=100%.

The information of the signals supplied by the sensor device 8 (FIG. 1) enables a calculation of the current rotational frequency of the electric motor 1 and of the movement of the plunger 4. It is advantageous to store in the calculation module 9 a travel model in which important parameters such as a current position of the closing body, final positions of the closing body 30 and a current speed, preferably the current rotational frequency of the electric motor 1 or, if necessary, the current speed of the closing body 30 are available.

The sensor device 8 preferably comprises a light source and a detector unit tuned to the spectrum of the light source, the light source being directed onto an optical pattern moved by the electric motor 1 such that with the electric motor 1 running light pulses reach the detector unit. The optical pattern is, for example, a disk arranged at the gear unit 2 and having optically reflecting zones, or having holes or teeth which are designed in such a way that a signal from the light source is modulated by the moving optical pattern.

However, it is also possible in principle for the sensor device 8 to be implemented differently, by means of an inductively operating device, for example.

In the second comparing device 12, an error signal ($p_S$−p) is formed from the desired position signal $p_s$ and the position signal p determined by the calculation module 9, and led to the second control module 13. A command variable for the first comparing device 10 is generated in the second control module 13. The command variable is advantageously a speed setpoint $\omega_S$. In the first comparing device 10, an error signal ($\omega_S$−ω) is formed from the speed setpoint $\omega_S$ and the speed signal ω determined by the calculation module 9, and led to the first control module 11. The control signal m for the motor driver module 7 is generated in the first control module 11 with the aid of the error signal ($\omega_S$−ω).

The inner control loop having the first control module 11 keeps the speed of the electric motor 1 constant. Consequently, rotating elements of the gear unit 2 mechanically coupled to the electric motor 1 and of the transformation element 3 are also controlled to constant rotational frequencies in each case in order to neutralize their moments of inertia. Controlling the electric motor 1 to a constant rotational frequency is attended by the advantages that a speed-dependent noise level of the actuating drive is also constant, and can be optimized by suitable selection of the speed setpoint $\omega_S$. Furthermore, the said speed control is associated with the advantage that self induction of electric motor 1 and moments of inertia of rotating elements of the actuating drive need not be taken into account in the calculation of a current estimate $F_E$ for the actuating force F.

One final position of an actuating element can be reliably determined when the actuating element is moved toward the final position, and in the process the current estimate $F_E$ for the actuating force F is calculated repeatedly by a computing module 40 (FIG. 5) of the actuating drive and is compared with a predetermined limiting value.

In a first variant, the estimate $F_E$ can be calculated only approximately using a linear formula A with the aid of the control signal m applied to the motor driver module 7 and of the battery voltage $U_B$. The product formed from the control signal m, the current value of the battery voltage $U_B$ and a first constant $k_U$ is reduced by a second constant $k_F$:

$$F_E=U_B\times k_U\times m-k_F \qquad \text{\{Formula A\}}$$

Owing to the fact that when calculating the estimate $F_E$ the speed signal ω attributed to the first comparing device 10 is also used in addition to the control signal m, a formula B yields an improved variant in which the estimate $F_E$ can be more accurately calculated. The speed signal ω is multiplied by a third constant $k_\omega$ and the resulting product is subtracted from the estimate $F_E$. The mathematical description of the drive model, and thus the formula B for the improved calculation of the estimate $F_E$ therefore runs:

$$F_E=U_B\times k_U\times m-k_\omega\times\omega-k_F \qquad \text{\{Formula B\}}$$

The formula B for calculating this estimate $F_E$ is built up in an optimized fashion with the three constants for an implementation suitable for microprocessors. It goes without saying that a suitable estimate of the actuating force can be calculated with the aid of formula B by mathematical conversion, for example associated with an increase in the number of constants used.

The three constants $k_U$, $k_\omega$ and $k_F$ can be determined with little outlay such that the estimate $F_E$ can be calculated with sufficient accuracy for determining the final position of the actuating element.

The three constants $k_U$, $k_\omega$ and $k_F$ take account of characteristic values or properties of the electric motor 1, the motor driver module 7, the gear unit 8 and the transformation element 3.

The computing module 40 comprises a data structure advantageously stored in a microcomputer of the actuating drive, and at least one program routine, which can be executed by the microcomputer, for calculating the estimate $F_E$. In order to calculate the estimate $F_E$, the current battery voltage $U_B$ is input, for example via an analog input of the microcomputer, in each case.

In an exemplary implementation of the computing module 40, the properties of the motor driver module 7 are taken into account by the first constant $k_U$, in particular, while it is chiefly characteristic values of electric motor 1 such as, for example, motor constant and DC resistance that are taken into account by the second constant $k_\omega$. The gear unit 8 is taken into account by the third constant $k_F$. Furthermore, the efficiency of the actuating drive is taken into account when calculating the estimate $F_E$ by having it flow into each of the three constants $k_U$, $k_\omega$ and $k_F$.

In FIG. 6, 60 denotes the actuating drive for the actuator 5 (FIG. 1). The actuating drive 60 has a drive unit 61, a gear unit 63, a control unit 62, the voltage source 6 (FIG. 1) implemented as a battery, a voltage regulator 64 and the sensor device 8 (FIG. 1).

The control unit 62 is assigned a transceiver unit 65 and a microcomputer unit 66.

The drive unit 61 comprises the motor driver module 7 (FIG. 1) and the electric motor 1 (FIG. 1). The gear unit 63 can be driven by the electric motor 1. The gear unit 63 acting with the actuating force F on the actuator 5 comprises the gear unit 2 (FIG. 1), the transformation element 3 (FIG. 1) and the plunger 4 (FIG. 1).

The transceiver unit 65 and the microcomputer unit 66 are connected to one another via a communication channel 68.

The control signal m (FIG. 1) for driving the motor driver module 7 is generated by the microcomputer unit 66. The signal s supplied by the sensor device 8 is guided to an input of the microcomputer unit 66.

The drive unit 61 and, advantageously, also the sensor device 8 are connected for the purpose of energy supply directly to the battery voltage $U_B$ of the battery 6, while the control unit 62 can be fed via the voltage regulator 64 connected to the battery 6.

The actuating drive 60 has an optimized energy management that is controlled by the microcomputer unit 66. In this case, the drive unit 61, the sensor unit 8 and the transceiver unit 65 are advantageously sequentially driven by the microcomputer unit 66 such that the electric energy drawn by the units 61, 8 and 65 occurs in a fashion that is offset in time and serrated and is not cumulative. Moreover, the maximum current consumption of the drive unit 61 is advantageously limited. Current peaks that—conditioned by an internal resistance $R_i$ of the battery 6—would lead to an impermissible drop in the battery voltage $U_B$ are avoided by the said sequential driving and the current limitation. In particular, so-called starting current peaks of the drive unit 61 are limited by the current limitation.

A bidirectional wireless data communication link can be built up between the transceiver unit 66 and an external station 70. The external station 70 is, for example, an operator panel, a control center or a higher-level control device. The external station 70 typically transmits a temperature setpoint, a position setpoint or an operating mode to the actuating drive 60 via the data communication link. Moreover, current state information relating to the actuating drive 60 can be transmitted to the external station 70 via the data communication link. In a typical variant, the external station 70 is a node embedded in a computer network 71.

The control unit 62 is fed via the voltage regulator 64 connected to the battery voltage $U_B$ so that the actuating drive 60 can communicate reliably to the outside. The voltage regulator 64 ensures a constant operating voltage $U_S$ for the control unit 62 independently of the respective current requirement of the drive unit 61 and the sensor unit 8.

The sensor device 8 comprises, for example, an optical pattern 72 that can be moved by the gear unit 63, a light source 73 and a detector unit 74. The signal s transmitted from the sensor device 8 to the microcomputer unit 66 is obtained by the detector unit 74 from the light signal of the light source 73, which is influenced by the optical pattern 72 by a movement of the gear unit 63.

The light source 73 can advantageously be controlled by a clock signal c generated by the microcomputer unit 66 in order to minimize the energy consumption. In an advantageous implementation of the sensor device 8, the latter has a modulation device 75 by means of which the light beam generated by the light source 73 can be modulated. A signal transformation effected by the modulation device 75 is advantageously taken into account in the microcomputer unit 66 by appropriate demodulation of the signal s supplied by the sensor device 8.

The electric motor 1 is controlled in every operating phase to a constant speed by means of the control signal m generated by the control unit 62. Consequently, with reference to its characteristic curve the electric motor 1 is always operated at an optimum operating point independently of the state of the voltage source 6 embodied by the battery.

The control unit 62 is ensured a reliable energy supply in the case of a high battery voltage $U_B$ and also in the case of heavy loading of the voltage source 6 caused by the drive unit 61 and the sensor unit 8 because of the fact that the control unit 62 is fed via the voltage regulator 64.

In an advantageous variant of the actuating drive 60, the latter has a switching device 76 for bridging the voltage regulator 64. The switching device 76 can be operated by the microcomputer unit 66 by means of an activation signal a. In the event of an exceptionally low battery voltage $U_B$—that is to say at the end of the service life of the battery—the switching device 76 yields the advantage that the voltage regulator 64 can be bridged automatically by the microcomputer unit 66 such that a voltage drop caused by the voltage regulator 64 is avoided by using the switching device 76 to connect the control unit 62 directly to the battery voltage $U_B$ for feeding purposes.

The invention claimed is:

1. A drive device for an actuator, operable to receive operating power from a battery, the drive device comprising:

a drive unit configured to operate the actuator, and a control unit, capable of communicating with an external station in a wireless fashion, configured to control the drive unit, wherein the drive unit has an electric motor configured to be controlled by the control unit, and a driver unit for the electric motor, wherein the control unit can be fed via a voltage regulator connected to the battery, and wherein the drive unit is directly connected to the output voltage of the battery; and wherein the control unit is configured to generate a control signal (m) for the driver unit such that a speed of the electric motor is controlled to a constant value (ωs).

2. The drive device as claimed in claim 1, wherein the control unit further comprises a transceiver unit for wireless communication with the external station.

3. The drive device as claimed in claim 2, wherein the control unit further comprises a microcomputer unit capable of communicating with the transceiver unit via a data interface.

4. The drive device as claimed in claim 3, wherein the transceiver unit is operable to transmit a wirelessly received position setpoint to the microcomputer unit.

5. The drive device as claimed in claim 3, wherein the transceiver unit is operable to transmit a wirelessly received temperature setpoint to the microcomputer unit.

6. The drive device as claimed in claim 3, wherein the voltage regulator is configured to be bridged by a deactivation signal generated by the control unit.

7. The drive device as claimed in claim 1, wherein the drive unit includes a sensor unit configured to detect the rotational frequency of the electric motor.

8. The drive device as claimed in claim 7, wherein the sensor unit includes a light source controlled in a pulsed fashion.

9. The drive device as claimed in claim 3, wherein the microcomputer unit is configured to generate a control signal for driving the drive unit in a manner based on optimizing energy consumption.

10. The drive device as claimed in claim 3, wherein, in order to optimize the energy consumption the light source of the sensor device can be controlled by a clock signal generated by the microcomputer unit.

11. The drive device as claimed in claim 3, wherein the drive unit and the sensor unit are sequentially driven by the microcomputer unit such that electric energy drawn by the drive unit and the sensor unit from the battery occurs in a temporary offset and noncumulative fashion.

* * * * *